US011653738B2

(12) United States Patent
Smith et al.

(10) Patent No.: US 11,653,738 B2
(45) Date of Patent: May 23, 2023

(54) LICE COMB AND METHODS OF MANUFACTURE AND USE

(71) Applicant: William V. MacGill & Co., Lombard, IL (US)

(72) Inventors: Justin Robert Smith, Lombard, IL (US); Wayne A. Huerth, North Barrington, IL (US)

(73) Assignee: William V. MacGill & Co., Lombard, IL (US)

( * ) Notice: Subject to any disclaimer, the term of this patent is extended or adjusted under 35 U.S.C. 154(b) by 303 days.

(21) Appl. No.: 16/891,370

(22) Filed: Jun. 3, 2020

(65) Prior Publication Data

US 2021/0378380 A1 Dec. 9, 2021

(51) Int. Cl.
*A45D 24/30* (2006.01)
*A45D 24/02* (2006.01)

(52) U.S. Cl.
CPC ..... *A45D 24/30* (2013.01); *A45D 24/02* (2013.01)

(58) Field of Classification Search
CPC ..... A45D 24/02; A45D 24/04; A45D 24/30; A45D 24/06; A45D 24/08; A45D 24/12; A45D 24/20; A45D 24/36; A46B 1/00; A46B 3/00; A46B 3/005; A46B 3/04
See application file for complete search history.

(56) References Cited

U.S. PATENT DOCUMENTS

| | | | | |
|---|---|---|---|---|
| 2,349,977 A | | 5/1944 | Mazzoni | |
| 2,481,403 A | | 9/1949 | Zazzo | |
| 4,345,608 A | | 8/1982 | Cavaioli et al. | |
| 4,502,498 A | | 3/1985 | Saferstein et al. | |
| 4,612,944 A | * | 9/1986 | Bachrach | A45D 24/30 132/219 |
| 4,612,945 A | * | 9/1986 | Bachrach | A45D 24/30 132/142 |
| 4,807,652 A | * | 2/1989 | Bachrach | A45D 24/30 15/207.2 |
| 4,819,670 A | * | 4/1989 | Saferstein | A45D 24/04 132/156 |

(Continued)

FOREIGN PATENT DOCUMENTS

| | | |
|---|---|---|
| CN | 108235957 A | 7/2018 |
| WO | 99/18800 A1 | 4/1999 |
| WO | 2018/224993 A1 | 12/2018 |

OTHER PUBLICATIONS

International Search Report for International Application No. PCT/US21/35445, dated Sep. 8, 2021, pp. 1-3.

(Continued)

*Primary Examiner* — Cris L. Rodriguez
*Assistant Examiner* — Karim Asqiriba
(74) *Attorney, Agent, or Firm* — McDonnell Boehnen Hulbert & Berghoff LLP

(57) ABSTRACT

Example embodiments relate to an improved plastic lice treatment comb as well as methods of manufacture and use of the comb. The lice plastic comb may have a front surface, a back surface, a grip portion, and a plurality of rigid plastic tines extending from the grip portion. The front surface of the grip portion includes an elongated plastic flow ridge which is adjacent to the base ends of the tines. The back surface of the grip portion includes a plastic flow restriction channel, which is spaced slightly back from the base ends of the tines.

12 Claims, 9 Drawing Sheets

(56) References Cited

U.S. PATENT DOCUMENTS

| | | | | |
|---|---|---|---|---|
| D353,225 | S | 12/1994 | Doran et al. | |
| 6,006,758 | A | 12/1999 | Thorne | |
| 6,035,806 | A | 3/2000 | Lorenzo | |
| 6,158,443 | A * | 12/2000 | Leman | A45D 24/10 132/219 |
| D820,517 | S | 6/2018 | Tanaka | |
| 2002/0078972 | A1 | 6/2002 | Levandovsky | |
| 2006/0283473 | A1 * | 12/2006 | Chudzik | A45D 24/22 132/156 |
| 2013/0340780 | A1 * | 12/2013 | Kuglen | A45D 8/12 132/219 |
| 2013/0340781 | A1 | 12/2013 | Liebel et al. | |
| 2016/0367009 | A1 * | 12/2016 | Cacciabaudo | A01K 13/002 |
| 2017/0196335 | A1 | 7/2017 | Porter | |
| 2018/0295965 | A1 * | 10/2018 | Buck, Jr. | A45D 24/02 |
| 2019/0008258 | A1 * | 1/2019 | Hallmark | A45D 24/02 |
| 2019/0133290 | A1 | 5/2019 | Schalla | |

OTHER PUBLICATIONS

Written Opinion from the International Searching Authority, for International Application No. PCT/US21/35445, dated Sep. 8, 2021, pp. 1-7.

"Draft Angles in Injection Molded Plastics", Natech Plastics, pp. 1-10. [Retrieved from the internet Mar. 6, 2020, >URL:https://www.natechplastics.com/draft_angles/<].

* cited by examiner

LICE COMB AND METHODS OF MANUFACTURE AND USE

FIELD

Embodiments presented herein are directed to an improved lice and nit removal comb as well as methods of manufacturing and using the comb. More specifically, example embodiments provide an inexpensive, plastic lice and nit removal comb that effectively removes lice and nits with minimal use.

BACKGROUND

A comb is a tool that typically includes several teeth arranged for styling and managing hair. Combs have several uses, including for cleaning and managing the hair and scalp of a person. As such, combs are often made out of plastic, metal, or wood and can vary in size and design.

One particular use for combs is the removal of lice and nits from hair. These combs are typically designed with fine-teeth that can pick out lice as a user combs through his or her hair. Because lice are so small in size, combs designed to remove lice from a person's hair (i.e., lice combs) may have designs that differ from traditional combs in order to reduce the amount of time a user might need to spend using a lice comb.

Some lice combs are constructed completely out of metal. These metal lice combs are typically manufactured via a CNC cutting machine precisely cutting gap to create closely spaced tines in a solid metal blank. Although a metal lice comb can remove lice from a person's hair effectively, manufacturing and material costs for these combs far exceeds the costs associated with producing conventional combs. In an effort to produce lower cost lice combs, producers have started incorporating plastic into lice comb designs. The use of plastic with lice combs, however, often resulted in a lice comb feeling flimsy during use. In addition, these combs may be ineffective for a user. In particular, the user might need to use a plastic lice comb significantly longer than the more expensive metal lice combs.

SUMMARY

The present disclosure describes example embodiments relating low cost, highly efficient lice and nit removal combs designed to remove lice and nits from hair with minimal use. An example lice comb may include a plastic configuration that enables a single pass clearance of lice/nits from one or more locks of hair of a scalp. In particular, the plastic configuration can also provide improved individual tine rigidity at a lower cost than comparable metallic options. Another embodiment depicts a method for the manufacture of the example plastic lice removal comb described above in a cost efficient manner. Furthermore, examples may involve using an improved plastic lice removal comb to more efficiently remove nits from an affected person's hair. It is still further object to provide a novel kit for lice/nit removal including an improved plastic lice removal comb and accessories for facilitating the lice/nit removal process.

In one aspect, an example plastic lice treatment combo is described. The plastic comb that has a front surface, a back surface, a grip portion, and a plurality of rigid plastic tines extending from the grip portion. The front surface of the grip portion includes an elongated plastic flow ridge which is adjacent to the base ends of the tines. The back surface of the grip portion includes a plastic flow restriction channel, which is spaced slightly back from the base ends of the tines. In some implementations, the plastic flow restriction channel and elongated plastic flow ridge are dimensioned to enhance the flow of plastic resin into the tines and restrict plastic flow into the grip portion of the comb in order to completely fill the tines portion of the mold during each injection molding shot. More specifically, the plastic flow ridge is located directly opposite the point where the mold gate supplies the molten plastic to the comb mold during an injection molding shot. The ridge is created by machining an elongated channel into the mold which creates a temporary reservoir of molten plastic, which can then flow into the narrow cavities forming the tines. The elongated flow restriction depression is located on the opposite surface of the comb and is placed between the gate and the grip end of the comb and is spaced closer to the grip end than the elongated ridge. The flow restriction depression is formed by machining an elongated projection into one half of the mold which extends into the mold cavity thereby restricting and slowing the flow of molten plastic toward the grip end of the comb during an injection molding shot. During each injection molding shot, the elongated projection slows the flow of the plastic toward the grip end of the comb enough that the plastic from the temporary reservoir created by the elongated channel can completely fill the tines and allows them to cool in the same amount of time as the grip portion of the comb fills and cools.

In another embodiment, the tines of the comb of the invention have a substantially rectangular cross-section which helps ensure that the tines are sufficiently rigid to resist excessive flexing when making contact with nits and lice. The tines of the comb of the invention are also made relatively short compared to prior art plastic lice combs. The length of the tine is preferably less than about ½ inch when measured along the front surface of the comb from the tine tip to the tine base. The tines are about ⅜ of an inch when measured along the back surface of the comb from tine tip to tine base. To further ensure sufficient tine rigidity, the tines are preferably about twice as thick as they are wide. The tines are preferably at least about 0.061 of an inch thick (front to back) and at least about 0.028 of an inch wide. To ensure effective nit removal, the tines are spaced closely together with a preferred tine gap of about 0.007 of an inch, and an effective range between about 0.004 to about 0.009 of an inch for those tine gaps. The tine tips also preferably have a beveled front surface to encourage smooth, non-abrasive contact with the user's scalp during nit removal strokes.

Another embodiment is directed to a novel lice/nit removal kit which includes an improved lice removal comb and one or more of the following lice removal accessories: (i) a disposable detangling comb having a plurality of wide spaced teeth, and (ii) a pre-treatment agent that lubricates the hair strands to facilitate passage of the improved lice removal comb through the patient's hair. The kit may also optionally include a cape for covering the shoulders of the patient to prevent lice or nits from getting on the patient's clothing and a post-nit removal medicated shampoo (including a licidal compound) to treat any nits/lice that were missed by the lice removal comb.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1A:
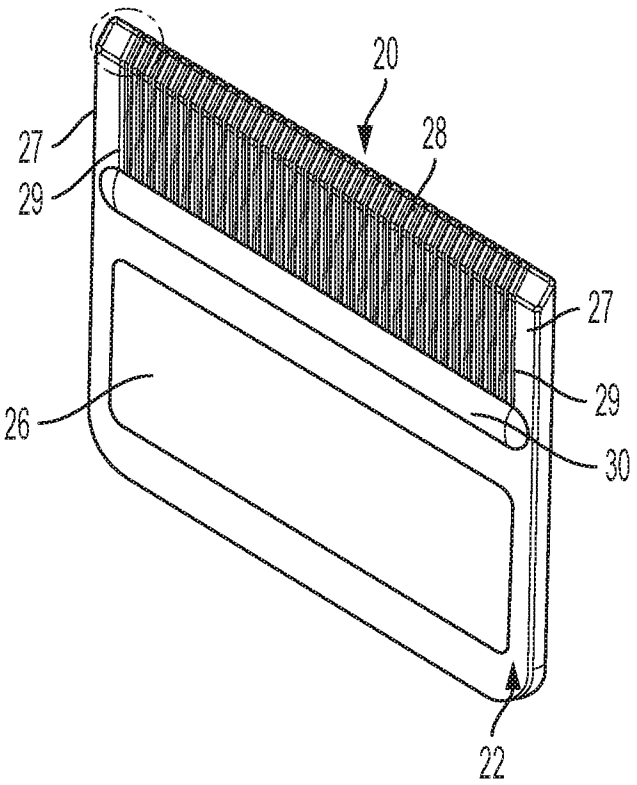
FIG. 1A illustrates a front view of a lice comb, according to one or more example embodiments.
Figure 1B:
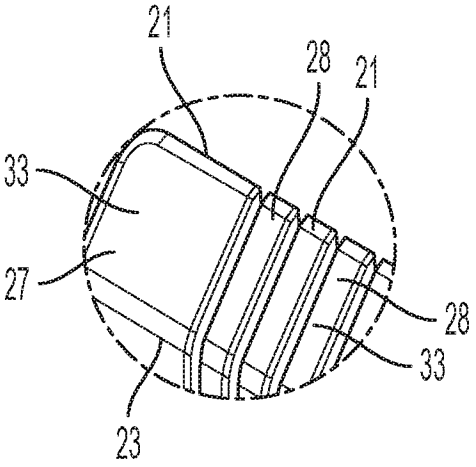
FIG. 1B illustrates an enlarged fragmentary front, perspective view of the tine tips of a lice comb, according to one or more example embodiments.

The following detailed description describes various features and functions of the disclosed systems and methods with reference to the accompanying Figures. The illustrative system and method embodiments described herein are not meant to be limiting. It may be readily understood that certain aspects of the disclosed systems and methods can be arranged and combined in a wide variety of different configurations, all of which are contemplated herein.

Further, unless context suggests otherwise, the features illustrated in each of the Figures may be used in combination with one another. Thus, the Figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

As discussed above, lice combs are often produced using plastic to help decrease overall manufacturing and material costs. Current plastic lice combs can be ineffective and require a user to make multiple passes through an area of hair to remove all the lice located therein. These plastic lice combs typically have tines with rounded cross-sections that decrease in circumference as the tine extends from the handle of the comb (i.e., the base of the tine is thicker than the tip of the tine). These design choices (i.e., rounded cross-section shape and tapering of the ends of the tines) are often selected to enable easy removal of each lice comb prior from the injection mold which formed them. Due to the rounding and tapering of the tines of these plastic lice combs, the gaps between adjacent tines are larger at their tips than at their base ends. Thus, when passing through a lock of hair, the rounded, tapered tines can sometimes bend toward the tines' tips causing the tines to flex a sufficient distance that allows some nits (lice eggs) to remain attached to hair.

Example embodiments presented herein are related to plastic lice combs that operate similar to metal lice combs and can be manufactured at low costs similar to the ineffective plastic lice combs described above. To further illustrate, an example plastic lice treatment comb may include a grip portion with a set of rigid tines extending away in a linear arrangement. Each rigid tine can include a base portion having a cylindrical structure and a tip portion have a rectangular structure. In some instances, the rectangular structure can be beveled on one or more sides such that the rectangular structure includes one or more corresponding slopes. The degree of the beveling can vary within embodiments. In addition, the tines may have a draft angle relative to the grid portion of the comb. For instance, the draft angle of the tines (or a subset of tines) could be between 2 and 45 degrees, and usually 3 degrees. The plastic comb may also include an elongated plastic flow ridge located adjacent to the base portions of the tines on the grip portion's front surface and a plastic flow restriction channel located on the grip portion's back surface. In some examples, the plastic flow restriction channel is positioned further from the tines than the elongated plastic flow ridge.

Manufacturing lice combs described herein may involve using molds and plastic resin. By way of another example, a method may involve initially providing a lice comb mold having a core half and a cavity half. Together, the mold's core half and cavity half define a grip cavity and tine cavities that can be used to generate a plastic lice treatment comb, such as the lice comb described in the above example. In order to produce such a design, the tine cavities in the mold are designed to extend away from the grip cavity in a linear arrangement and create a tine outline capable of creating the unique structure of the tines described above with a base portion have a cylindrical structure and a tip portion having a rectangular structure with a beveled side. In addition, the mold may include other features to create elements of a comb. For example, the mold may include an elongated plastic flow ridge forming cavity located adjacent to the tine cavities, and a plastic flow restriction channel forming ridge being spaced further from the base ends of the tines within the grip cavity than the elongated plastic flow ridge forming cavity.

The example method may further involve injecting a molten plastic resin into the mold. For example, the molten plastic resin can be injected at the mold gate located within the grip cavity to enable the molten plastic resin to flow from the gate into the elongated plastic flow ridge cavity to create a temporary reservoir of molten plastic adjacent to the plurality of tine cavities. The molten plastic resin flows within the mold into the tine cavities such that each rigid tine includes a base portion having a cylindrical structure and a tip portion having a rectangular structure beveled on one side and such that the rigid tines have draft angle typically between 2 and 45 degrees, usually 3 degrees. The molten plastic flow can further slow at the elongated mold projection toward the grip end of the comb for a sufficient time during each mold shot cycle that the molten plastic temporary reservoir created by the elongated cavity can completely fill the tines and allows them to cool in substantially the same amount of time as the grip portion of the comb fills with plastic and cools. The method can subsequently involve ejecting the plastic lice treatment comb from the mold.

Figure 2:
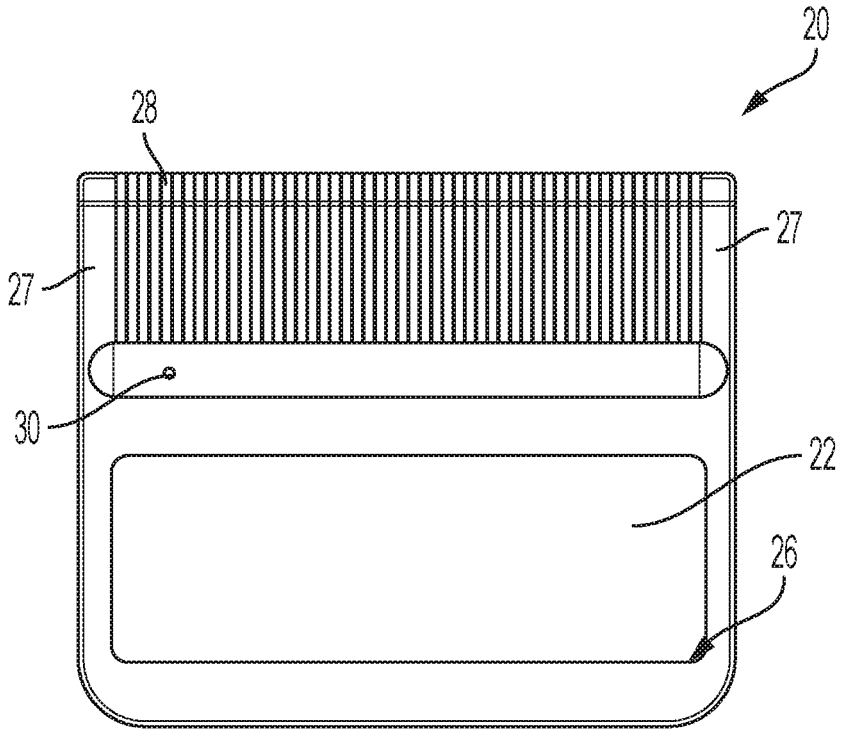
FIG. 2 illustrates another view of a lice comb, according to one or more example embodiments.
Figure 3:
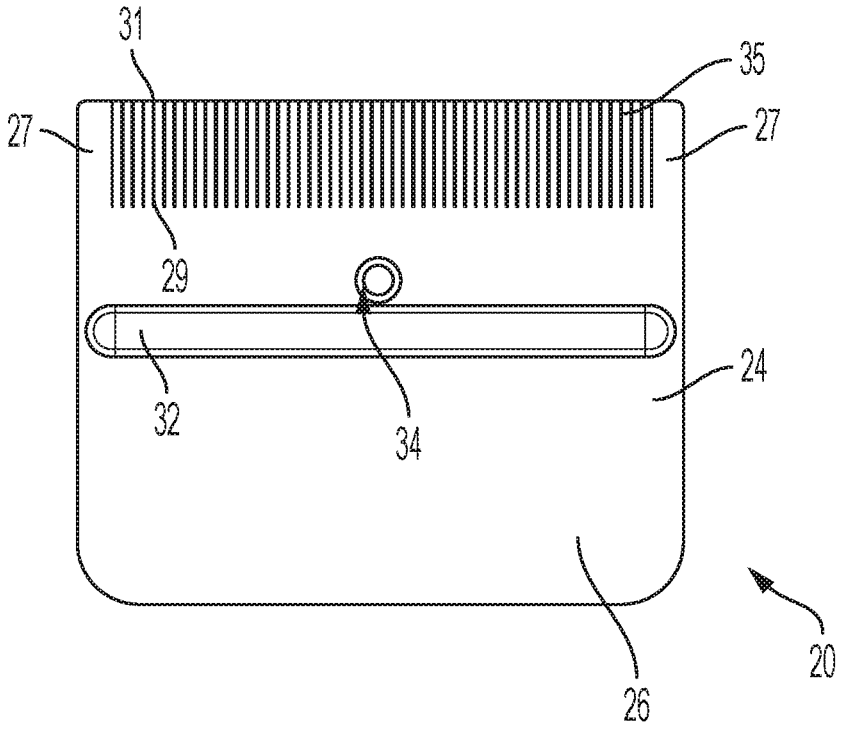
FIG. 3 illustrates a back view of the lice comb, according to one or more example embodiments.
Figure 4A:
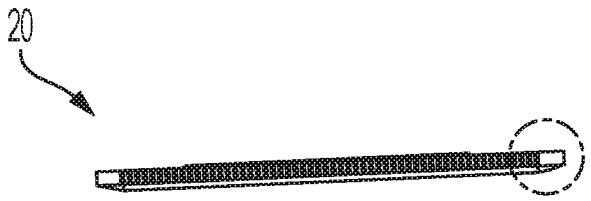
FIG. 4A illustrates a top view of a comb, according to one or more example embodiments.
Figure 4B:
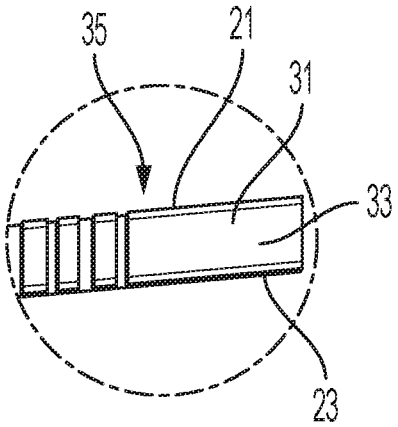
FIG. 4B illustrates an enlarged perspective view of the comb, according to one or more example embodiments.

Referring now to the Figures, different embodiments related to lice combs are described and illustrated in FIGS. 1A-11C. As shown in FIGS. 1A, 2, and 3, the lice removal comb 20 includes a front surface 22, a back surface 24, a grip 26, and a set of rigid plastic tines 28 extending from the grip 26 in between side components 27. Each of the tines 28 has a base end 29 and a tip 31. The base end 29 may represent the base portion of each tine and the tip 31 may represent the tip portion of each tine. The front surface 22 of grip 24 includes an elongated plastic flow ridge 30 which is adjacent to the base ends 29 of the tines 28. The back surface 24 of the grip 26 includes a plastic flow restriction channel 32, which is spaced slightly back from the base ends 29 of the tines 28.

Figure 5:
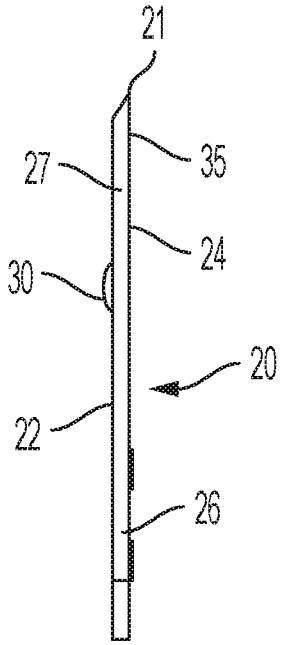
FIG. 5 illustrates a side view of a comb, according to one or more example embodiments.
Figure 6:
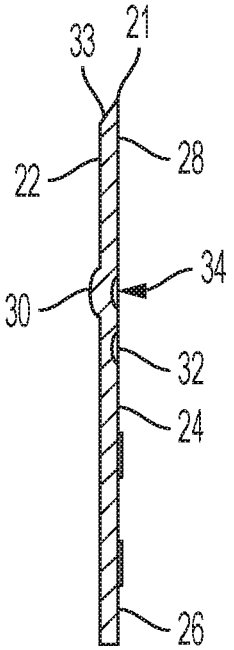
FIG. 6 is a side, cross-sectional view of a comb, according to one or more example embodiments.
Figure 7:
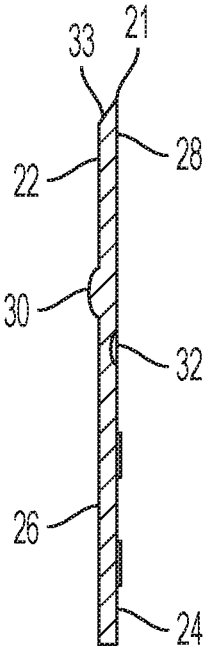
FIG. 7 is another side, cross-sectional view of the comb, according to one or more example embodiments.

As shown in FIGS. 1B, 4A and 4B, and 5, one or more of the tips 31 of tines 28 can have a lead edge 21, a trail edge 23, a beveled front surface 33 and a planar back surface 35. As can be seen when comparing FIGS. 3, 4A and 4B, the distance between the tine tips 31 and tine bases 29 can be greater on the front surface 22 than the back surface 24 of the comb 20 as depicted in the illustrated embodiment. In contrast with the flimsy rounded, prior art plastic comb tines, the tines 28 of the comb 20 can have a rectangular cross-section as shown in FIG. 5. The rectangular cross-section can help ensure that the tines 28 are sufficiently rigid to resist excessive flexing when making contact with nits and lice during a removal stroke.

In addition, to ensure effective nit removal, the tines 28 can be spaced closely together, such as within a range approximately 0.004-0.009 inches. For example, the tines 28 can be spaced such that gaps between adjacent tines are about 0.007 of an inch. In other embodiments, the gaps between different pairs of tines can differ. For instance, the gap size between a first set of adjacent tines can differ from the gap size between a second set of adjacent tines.

The beveled front surface 33 of the tines 28 can enable smooth and non-abrasive (or less abrasive) contact with the user's scalp during each removal stroke. As shown in the example embodiment, the beveled front surface 33 can be formed in the front surface 22 of the comb 20.

In some embodiments, the tines 28 of the comb 20 are made relatively short compared to other lice combs. The short tine length can help maintain the rigidity of each tine and reduce flexing during nit removal. In addition, the short tine length can allow the plastic resin to reach the tips 31 of the tines 28 during the injection molding process as explained in more detail below. In the embodiment shown in the Figures, the length of the tine 28 is less than about 0.5 inches when measured along the front surface 22 of the grip 26. The tines 28 are less than about ⅜ of an inch in length when measured along the back surface 24 of the comb 20. To further enhance tine rigidity, when viewed in cross-section, the tines 28 are substantially thicker than they are wide in the example embodiment. In some examples, the tines 28 are at least about 2 times as thick (front to back) as they are wide. More specifically, the tines 28 of the illustrated embodiment are at least about 0.061 of an inch thick (measured from the front surface 22 to the back surface 24) and about 0.028 of an inch wide.

A pair of wider guard tines 37 may also be located along the lateral exterior edges of the tines 28 as shown in the example embodiment. The guard tines 37 may also have a beveled front surface 33, lead edge 21 and trail edge 23. The trail edge 23 can be continuous with those surfaces/edges on the tines 28. The wider guard tines 37 can contribute to the overall rigidity and structural integrity of the comb 20 as well as to the lateral stability for resisting side-ways deflection of the tines 28. The grip portion 26 is beveled from front to back between each of the tines 28 of the comb 20. The short, rigid tines 28 of the comb 20 are effective at nit removal since viable (not yet hatched) lice nits are typically attached to individual hairs very near the scalp at between about 1/16 of an inch and ¼ of an inch from the scalp.

One challenge with manufacturing an effective plastic lice comb is that the process of injection molding very narrow plastic part features like closely space tines 28 can be difficult. This is because the closely spaced tines 28 require a large number of very small, very narrow, closely spaced mold cavities sections to form the tines 28. During an injection molding shot, it is difficult to ensure that all of the narrow tines forming cavities are completely filled with a plastic resin during each injection cycle. Further, assuming that the tine mold cavities have become completely filled during each shot, it then becomes a challenge to get each of the narrow tines 28 to release from the mold without some of the tines breaking or sticking to the mold. Some conventional strategies to minimize tine release/breakage issues for molded plastic lice removal combs include spacing plastic tines further apart, making the tines thicker or larger, giving the tines a circular cross-section, and/or tapering the tines from their grip ends to their tips. While these combinations of strategies can help solve the problem of tine cavity plastic fill and tine release, the resulting lice combs were less efficient to use for nit removal than desirable. As mentioned above, firmly attached nits frequently were able to resist multiple passes of flimsy conventional plastic lice removal combs.

Example methods described herein can overcome the challenge of injection molding plastic comb tines while not compromising the efficiency of the comb's performance at nit removal. As shown above, the comb can be designed with an elongated plastic flow ridge 30, which is dimensioned to improve the flow of plastic resin into the tines 28 during the molding process. More specifically, the elongated plastic flow ridge 30 is shown located directly opposite the point where the injection mold gate (see the gate mark 34) supplies the molten plastic to the mold during an injection molding shot.

The plastic flow ridge 30 can be created by machining an elongated cavity into one half of the comb injection mold. The plastic flow ridge is placed between the tine cavities and the location of the plastic gate. During an injection mold shot, molten plastic flows from the gate into the elongated cavity and creates a temporary reservoir of molten plastic adjacent to the tine cavities. This temporary reservoir of molten plastic improves the flow of plastic into the narrow tine cavities that form each of the tines 28.

In order to enhance the balance of the plastic flow between the tines 28 and grip portion 26 during an injection shot, a plastic flow restriction channel 32 is located on the back surface 24 of the comb 20. The plastic flow restriction channel 32 is placed further toward the grip end 26 of the comb further away from the tines 28 than the elongated flow ridge 30. The plastic flow restriction channel 32 is formed by machining (cutting away excess mold material) an elongated mold projection into a second half of the comb injection mold, which can be dimensioned to extend into the mold cavity a sufficient distance to restrict the flow of molten plastic from the gate toward the grip end of the comb 20 during an injection mold shot.

During each injection molding shot, the elongated mold projection can slow the flow of the plastic toward the grip end 26 of the comb 20 enough that the plastic from the temporary reservoir created by the elongated cavity can completely fill the tines 28 and allows them to cool in the same amount of time as the grip portion 26 of the comb 20 fills with plastic and cools. The plastic resin used to manufacture the comb 20 may be a relatively high durometer nylon plastic resin such as Vydne™ 21SPF Polyamide 66 manufactured by Ascend Performance Materials Operation LLC of Houston, Tex. However, other relatively rigid plastic resins may be utilized, such as polystyrene, polyethylene, and polypropylene.

Prior to use of the comb, the efficiency of nit removal can be increased by pretreating the patient's hair with a substance that weakens the bond between the proteinaceous substance that glues the nits to individual hair follicles. Infested hair pretreatment can include substances such as vinegar, hair conditioners, or medicated shampoos. However, the comb may also be used without any pretreatment. In use, the improved lice removal comb 20 is designed for uni-direction lice/nit removal strokes in which the beveled front surface 33 first contacts the patient's scalp comb 20 angled so that the front surface 22 is directed toward the scalp and the back surface 24 angles away from the scalp. During each lice/nit removal stroke, the comb 20 is moved in the direction of its beveled front surface 33. The short, rectangular (cross-section), rigid tines 28 of the comb 20 do not deflect when making contact with lice or nits so that each removal stroke removes substantially all the lice and nits within the stroke path in a single pass. The process is repeated until the affected person's entire scalp has received at least one removal stroke with the comb 20. Of course, for affected persons with long hair, the hair should be sectioned and pinned up to prevent re-infestation of already combed hair from the uncombed portions of the scalp/hair.

Figure 8:
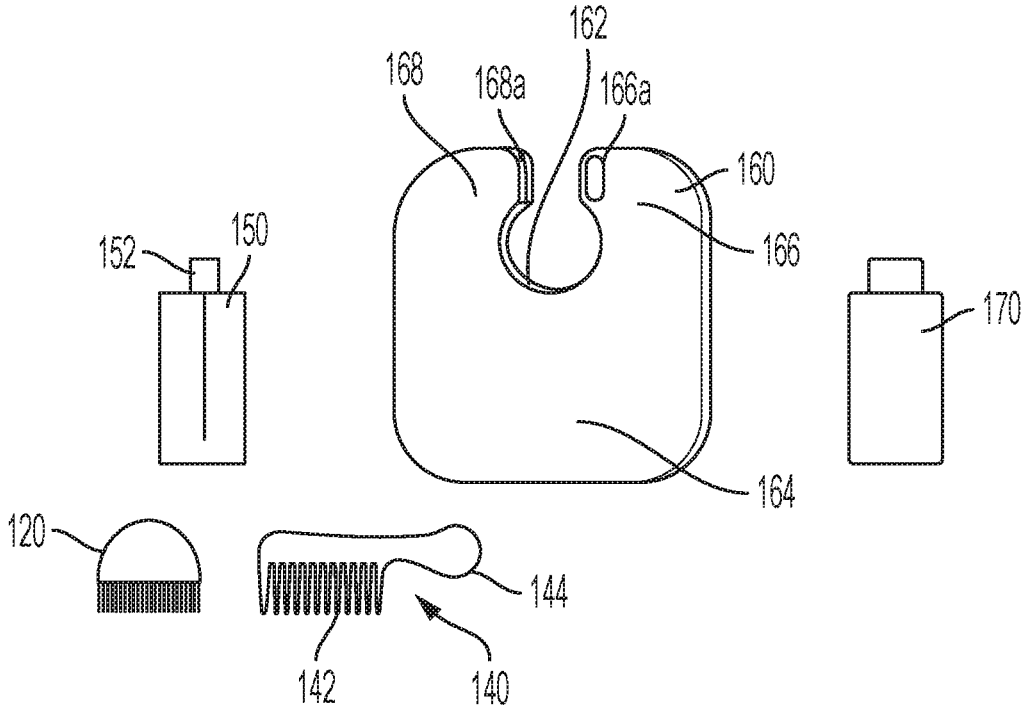
FIG. 8 illustrates a removal kit, according to one or more example embodiments.

FIG. 8 illustrates a kit 110 according to one or more example embodiments. As shown, the kit 110 can include an improved lice removal comb 120, a detangling comb 140, and a lubricating pre-treatment 150. Optionally, the kit 110 may further include a cape 160 and a post-treatment shampoo 170. The lice removal comb 120 is preferably disposable, that is, the comb 120 is manufactured from a low cost plastic resin material so the comb 120 is inexpensive enough to discard after a single use. The disposable lice removal comb 120 includes all the features of the comb 20 described above and is therefore cost effective, disposable and highly effective. The low cost disposable design of the lice removal comb 120 eliminates the need to clean the comb re-infect the same patient or transmit lice to a another patient. The detangling comb 140 is also made from low cost, plastic resin and has tines 142 that are spaced wide apart to untangle the patient's hair prior to use of the fine toothed lice removal comb 120. The comb tines 142 are separated by a gap between about $1/16^{th}$ and about $1/8^{th}$ of an inch.

The detangling comb 140 has a handle portion 144 for gripping the detangling comb 140 to facilitate the passage of the comb through tangled or curly hair. The detangling comb 140 is preferred injection molded using a nylon 66 resin, another low cost, plastic resin. The detangling comb 140 is also intended to be a low cost, single use disposable device to avoid the risk of passing lice or nits onto another patient or to re-infect a single patient.

The conditioner pre-treatment 150 preferably includes one or more of the following ingredients: glycerol, propylene glycol, panthenol, hyaluronic acid, fatty alcohols, polyquaternium polymers, and cationic surfactants. Commercial hair conditions are also suitable. The main purpose of the pre-treatment is to lubricate the strands of hair to ease passage of the lice removal comb 120 through the strands of hair. Alternatively, the pre-treatment 150 can be deionized water or another liquid which lubricates the movement of the lice removal comb 120 through the strands of hair. The pre-treatment 150 preferably includes a spray pump 152 for spraying the pre-treatment 150 onto the patient's hair.

The cape 160 includes a neck hole 162 for passing the cape 160 around the patient's shoulders. The cape 160 further has a front portion 164 for covering the patient's chest area and a pair of arms 166 and 168 that define the periphery of the neck hole 162. The pair of projections 166 and 168 each has a fastener portion **166*a* and 168*b* for retaining the cape 160 around the patient's neck. The preferred fastener portions 166*a* and 168*b* are the hook portion and loop portion of a Velcro fastener, but may also be a male/female portions of a plastic or metallic snap fastener (not shown) or a pair of straps (not shown) for tying off behind the patients head. The cape 160 is made from an inexpensive nonwoven fabric, plastic or paper material as the cape 160** is also designed for a single use to prevent the risk of re-infestation.

Preferably, the post-treatment shampoo 170 includes at least one ingredient designed to kill both viable nits (living lice eggs) and live lice. Accordingly, the shampoo post-treatment 170 preferably contains either piperonyl butoxide or pyrethrins, but may also contain Spinosad™ dimethicone, natrum muriaticum, carboxylic acids, or similar licidal compounds. The post-treatment shampoo also includes surfactants such as ammonium lauryl sulfate or sodium lauryl sulfate for cleansing the hair and removing any excess pre-treatment remaining in the patient's hair after combing with the lice removal comb 120.

Further, the kit may optionally include a water spray bottle in order to spray the patient's hair prior to treatment with the improved lice comb. Since lice tend not to move when wetted down with water. The end user fills the spray bottle with tap water, then sprays the conditioned hair and start combing with the improved plastic comb. The kit may also include a disposable plastic flossing tool since the closely placed, rigid tines are too close together for a tooth brush or other traditional lice comb cleaning method. Instead, the dental floss portion of the flossing tool slides between the teeth to thoroughly clean the comp.

Figure 9:
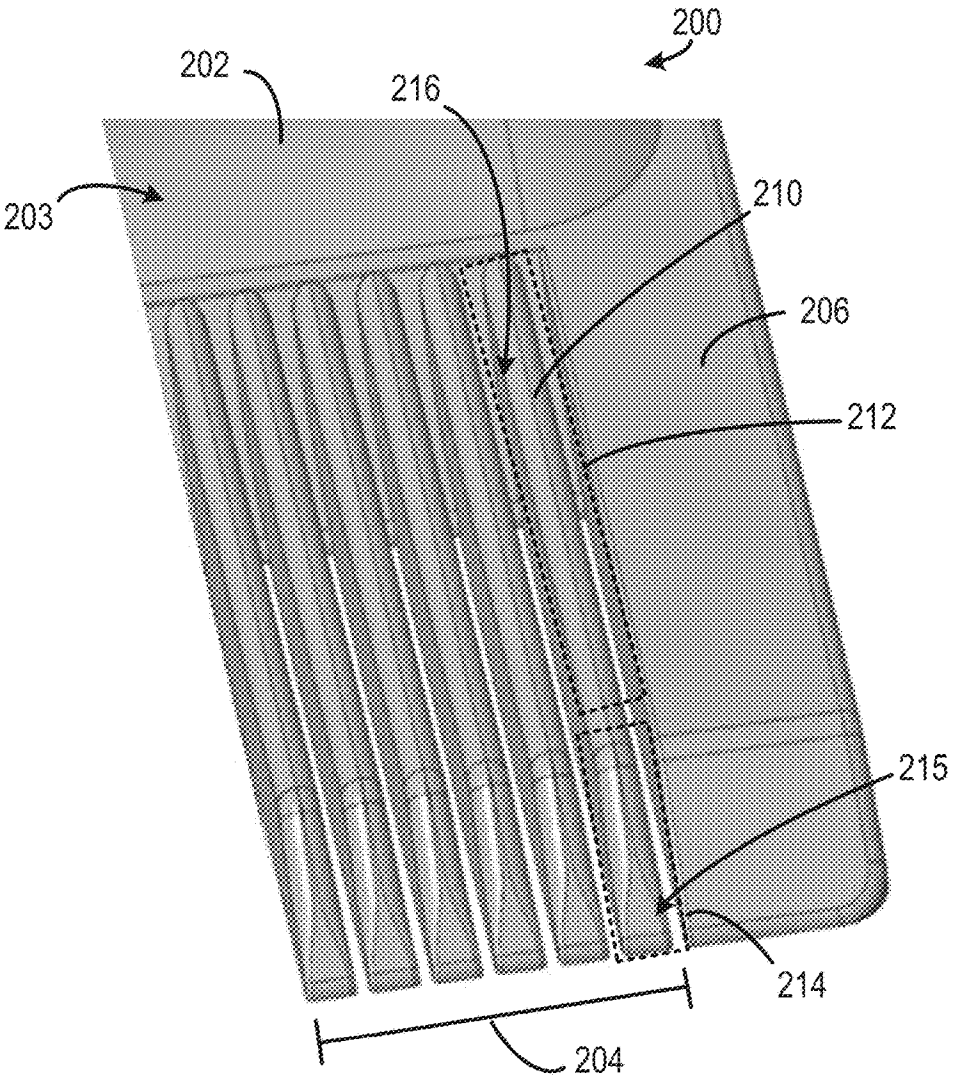
FIG. 9 illustrates a lice comb, according to one or more example embodiments.

FIG. 9 further illustrates a portion of a plastic lice treatment comb, according to one or more embodiments. The portion of the lice comb 200 includes a grip portion 202 molded from a plastic resin. The grip portion 202 includes a front surface 203 and a back surface (not shown in FIG. 9). In addition, the comb 200 also includes rigid tines 204 extending from the grip portion 202 of the comb in a linear arrangement and on the same plane. The quantity, size, configuration of the rigid tines 204 can vary within examples. One or more rigid tines 204 (e.g., tine 210) can include a base portion 212 having a cylindrical structure and a tip portion 214 having a rectangular structure beveled on one side 215 as shown in FIG. 9. The lice comb 200 may also include one or more side components, such as side component 206.

In addition, the rigid tines 204 can have a draft angle relative to the grip portion 202. For example, the draft angle may extend between 2 and 180 degrees, usually between 2 and 45 degrees, and typically 3 degrees. As shown in FIG.

9, the tine 210 includes a 3 degree draft angle 216 at the base portion 212 that couples to the grip portion 202.

In some examples, one or more tines of the lice comb 200 may have a rectangular structure for the base portion. In particular, the tine 208 may include a one degree draft angle at the base portion coupled to the grip portion 202 of the lice comb 200. As such, the lice comb 200 can include one or more types of tines within embodiments.

Figure 11A:
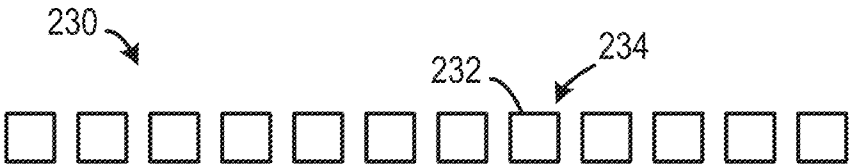
FIG. 11A illustrates a perspective view of a set of tines in a linear arrangement, according to one or more example embodiments.
Figure 11B:
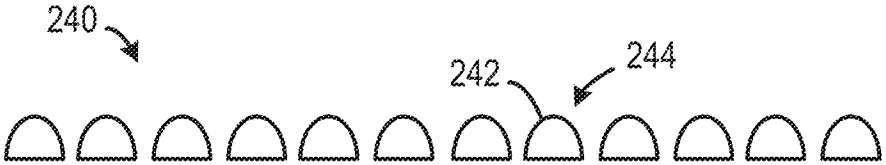
FIG. 11B illustrates a perspective view of another set of tines in a linear arrangement, according to one or more example embodiments.
Figure 11C:
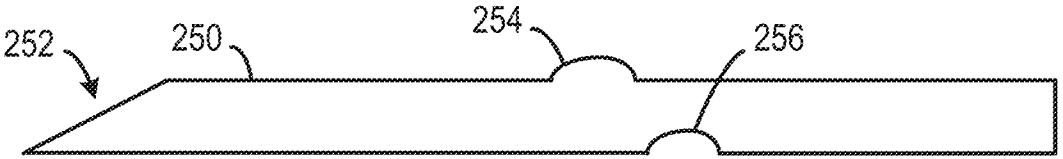
FIG. 11C illustrates a side view of a tine, according to one or more example embodiments.

To further illustrate, FIGS. 11A, 11B, and 11C illustrate sets of tines that can be part of lice combs described herein, according to one or more example embodiments. In particular, FIG. 11A shows a perspective view of a set of tines 230 arranged in a linear arrangement. As shown, tine 232 as well as the other tines 230 may include a rectangular structure with a one degree draft angle 234. As such, the set of tines 230 may connect to a base of a lice comb with the one degree draft angles shown.

FIG. 11B illustrates a perspective view of another set of tines 240 arranged in a linear arrangement. The tine 242 is shown with a 3 degree draft angle 244, which differs from the example shown in FIG. 11A. As such, the set of tines 240 may connect to a base of a lice comb with the 3 degree draft angles shown.

FIG. 11C shows tine 250 from another perspective. In particular, the tine 250 includes a bevel end 252, a plastic flow ridge 254, and a plastic flow restriction channel 256.

The angle of the bevel end 252 can vary within examples. The tine 250 may represent tines used for one or more lice combs described herein. In other examples, the tine 250 may have another configuration.

The comb 200 can also include an elongated plastic flow ridge 254 located adjacent to respective base portions of the rigid tines on the front surface of the grip portion. The comb 900 further includes a plastic flow restriction channel 256 located on the back surface of the grip portion 202. The plastic flow restriction channel is positioned further from the respective base portions of the rigid tines 204 than the elongated plastic flow ridge. In some examples, a depth of the plastic flow restriction channel is configured to slow plastic resin flow toward a lower end of the grip portion during an injection molding process used to form the comb.

In some embodiments, the length between the base portion and the tip portion for each rigid tine is less than about one half inch when measured along the front surface of the comb. Further, the length between the base portion and the tip portion for each rigid tine can be about three eights of an inch when measured along the back surface of the comb 200.

In some embodiments, one or more rigid tines (e.g., rigid tine 208) can include a front surface, a back surface, a first side surface, and a second side surface. In particular, each rigid tine of the plurality of tines are about twice as thick, measured from the front surface to the back surface of the tines, as wide, measured from the first side surface to the second side surface.

Figure 10:
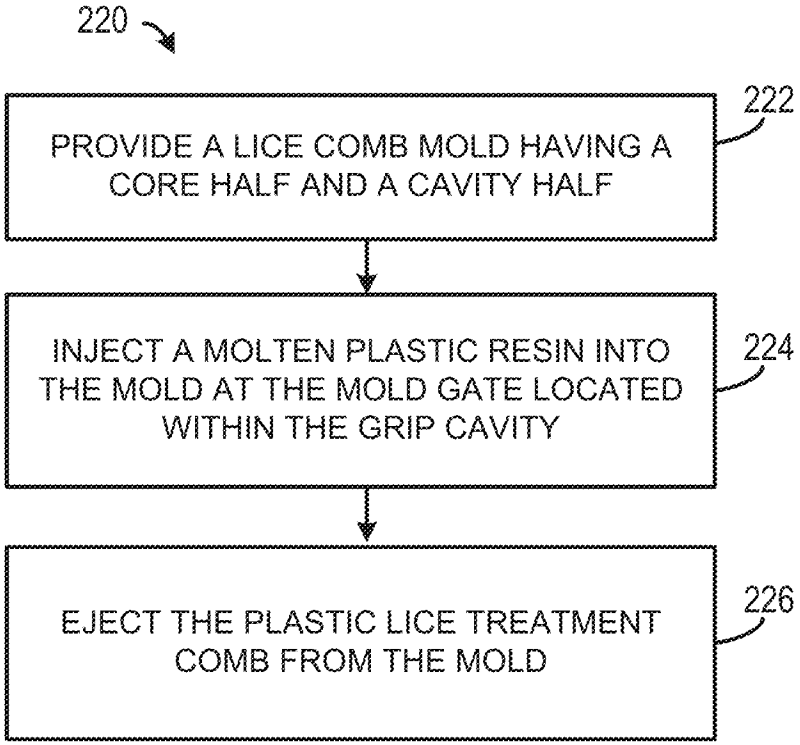
FIG. 10 illustrates a method for manufacturing a lice comb, according to one or more example embodiments.

FIG. 10 shows a method for manufacturing a plastic lice treatment comb, according to one or more example embodiments. The method 220 may involve one or more blocks that can be performed to generate a plastic lice treatment comb.

At block 222, the method 220 may involve providing a lice comb mold having a core half and a cavity half. The core half and the cavity half of the mold may define a grip cavity and a plurality of tine cavities for forming a plastic lice treatment comb. The plurality of tines cavities extend from the grip cavity in a linear arrangement.

Each tine cavity may include a base portion cavity configured to form a cylindrical structure and a tip portion configured to form a rectangular structure beveled on one side. In addition, the mold may further include a mold gate located within the grip cavity, an elongated plastic flow ridge forming cavity located adjacent to the base end of the plurality of closely spaced tine cavities, and a plastic flow restriction channel forming ridge being spaced further from the base ends of the tines within the grip cavity than the elongated plastic flow ridge forming cavity.

In some examples, the elongated plastic flow ridge is located directly opposite the point where the injection mold gate supplies the molten plastic to the mold cavity during an injection molding shot. In addition, the elongated plastic flow ridge can be located directly opposite the point where the injection mold gate supplies the molten plastic to the mold cavity during an injection molding shot.

In some embodiments, the plastic flow restriction forming channel is formed by cutting away excess mold material to form an elongated projection extending into one of the core half and the cavity half of the lice comb mold. For instance, the elongated projection can be dimensioned to extend into the mold cavity a sufficient distance to restrict the flow of molten plastic from the gate toward the grip end of the comb during an injection mold shot.

In some examples, the plastic flow restriction forming channel extends at least one third of the width of the thickness of the handle portion cavity. Further, the elongated plastic flow ridge extends at least one quarter of the width of handle portion cavity. Each of the plurality of plastic tine cavities have a rectangular cross-section with thickness and width dimensions substantially consistent between the base portion of each of the plurality of tine cavities adjacent the grip portion of the comb to the beveled tip portion of each of the plurality of tines.

At block 224, the method 220 may further involve injecting a molten plastic resin into the mold at the mold gate located within the grip cavity. Injecting the molten plastic resin may cause the molten plastic to flow from the gate into the elongated plastic flow ridge cavity to create a temporary reservoir of molten plastic adjacent to the plurality of tine cavities thereby speeding the flow of plastic into the plurality of tine cavities such that each rigid tine includes a base portion having a cylindrical structure and a tip portion having a rectangular structure beveled on one side and such that the rigid tines have draft angle between 2 and 180 degrees, generally between 2 and 45 degrees, and usually 3 degrees.

In addition, the molten plastic flow may slow at the elongated mold projection toward the grip end of the comb for a sufficient time during each mold shot cycle that the molten plastic the temporary reservoir created by the elongated cavity can completely fill the tines and allows them to cool in substantially the same amount of time as the grip portion of the comb fills with plastic and cools.

At block 226, the method 220 may also involve ejecting the plastic lice treatment comb from the mold. In some embodiments, the plastic lice treatment comb may be part of a lice and nit treatment kit. The kit may include a plastic lice removal comb having a grip portion molded from a plastic resin. The grip portion includes a front surface and a back surface and a plurality of rigid plastic tines extending from the grip portion of the comb in a linear arrangement. Each rigid tine may include a base portion having a cylindrical structure and a tip portion having a rectangular structure beveled on one side, and the rigid tines can have a draft angle between 2 and 180 degrees. The kit may also include a disposable detangling comb having a plurality of widely spaced teeth, the gap between substantially all of the plurality of adjacent widely spaced teeth is greater than 0.10 of an inch; and a pre-treatment agent that lubricates the hair strands to facilitate passage of the lice removal comb through hair of a patient.

The kit may also include a post-nit removal medicated shampoo, a condition, or both having a licidal compound to treat any remaining lice and nits. In some instances, the kit may further include a cape for covering shoulders of the patient to prevent lice and nits from falling on clothing of the patient and a lice treatment comb cleaning floss and a spray bottle for wetting hair of the patient.

It should be understood that arrangements described herein are for purposes of example only. As such, those skilled in the art will appreciate that other arrangements and other elements (e.g., machines, interfaces, orders, and groupings of operations, etc.) can be used instead, and some elements may be omitted altogether according to the desired results.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. It is also to be understood that the terminology used herein is for the purpose of describing particular implementations only, and is not intended to be limiting.

What is claimed is:

1. A plastic lice treatment comb comprising:

a grip portion molded from a plastic resin, wherein the grip portion includes a front surface and a back surface;

a plurality of rigid tines extending from the grip portion of the comb in a linear arrangement, wherein each rigid tine includes a base portion having a cylindrical structure and a tip portion having a rectangular structure beveled on a front surface and planar on a back surface, and wherein the rigid tines have a draft angle between 2 and 180 degrees;

a pair of guard tines for resisting sideway deflection of the plurality of rigid tines, each guard tine located along an exterior lateral edge of the plurality of rigid tines, each guard tine including, a tip portion beveled on a front surface and planar on a back surface, wherein the front beveled surfaces of the guard tines are continuous with the front beveled surfaces of the plurality of rigid tines;

an elongated plastic flow ridge located adjacent to respective base portions of the rigid tines on the front surface of the grip portion; and a plastic flow restriction channel located on the back surface of the grip portion, wherein the plastic flow restriction channel is positioned further from the respective base portions of the rigid tines than the elongated plastic flow ridge.

2. The plastic lice treatment comb of claim 1, wherein a depth of the plastic flow restriction channel is configured to slow plastic resin flow toward a lower end of the grip portion during an injection molding process used to form the comb.

3. The plastic lice treatment comb of claim 1, wherein a length between the base portion and the tip portion for each rigid tine is less than about one half inch when measured along the front surface of the comb.

4. The plastic lice treatment comb of claim 1, wherein a length between the base portion and the tip portion for each rigid tine is about three eighths of an inch when measured along the back surface of the comb.

5. The plastic lice treatment comb of claim 1, wherein each rigid tine of the plurality of tines includes a front surface, a back surface, a first side surface, and a second side surface, and wherein each rigid tine of the plurality of tines are about twice as thick, measured from the front surface to the back surface of the tines, as wide, measured from the first side surface to the second side surface.

6. The plastic lice treatment comb of claim 1, wherein each rigid tine of the plurality of rigid tines has a front surface, a back surface, a first side surface and a second side surface, and wherein one or more rigid tines is about 0.061 of an inch thick measured from the front surface to the back surface and at least about 0.028 of an inch wide measured from the first side surface to the second side surface.

7. The plastic lice treatment comb of claim 6, wherein one or more rigid tines is beveled between the tine front surface and the tine back surface at the tip portion.

8. The plastic lice treatment comb of claim 6, wherein adjacent rigid tines are spaced apart resulting in a gap between about 0.004 of an inch and 0.009 of an inch.

9. The plastic lice treatment comb of claim 6, wherein one or more tines include a rectangular cross-section with thickness and width dimensions substantially consistent between the base portion and the tip portion.

10. A plastic lice treatment comb comprising:

a grip portion molded from a plastic resin, wherein the grip portion includes a front surface and a back surface;

a plurality of rigid tines extending from the grip portion of the comb in a linear arrangement, wherein each rigid tine of the plurality of rigid tines has a front surface, a back surface, a first side surface and a second side surface; wherein each rigid tine includes a base portion having a cylindrical structure and a tip portion having a rectangular structure beveled on the front surface and planar on the back surface; wherein one or more rigid tines is about 0.061 inch thick measured from the front surface to the back surface and at least about 0.028 inch wide measured from the first side surface to the second side surface; wherein the plurality of rigid tines are spaced apart resulting in a gap ranging between about 0.004 inch and 0.009 inch; and wherein the rigid tines have a draft angle between 2 and 180 degrees;

a pair of guard tines for resisting sideway deflection of the plurality of rigid tines, each guard tine located along an exterior lateral edge of the plurality of rigid tines, each guard tine including, a tip portion beveled on the front surface and planar on the back surface, wherein the front beveled surfaces of the guard tines are continuous with the front beveled surfaces of the plurality of rigid tines;

an elongated plastic flow ridge located adjacent to respective base portions of the rigid tines on the front surface of the grip portion; and a plastic flow restriction channel located on the back surface of the grip portion, wherein the plastic flow restriction channel is positioned further from the respective base portions of the rigid tines than the elongated plastic flow ridge.

11. The plastic lice treatment comb of claim 10, wherein the beveled surfaces of the plurality of rigid tines and guard tines includes a lead edge and a trail edge.

12. The plastic lice treatment comb of claim 10, wherein the length of the plurality of rigid tines and guard tines is less than 0.5 inches when measured along the front surface of the grip portion and less than ⅜ inches when measure along the back surface of the comb.

* * * * *